US006119617A

United States Patent [19]

Oswell

[11] Patent Number: 6,119,617

[45] Date of Patent: Sep. 19, 2000

[54] TOW ROPE SHOCK ABSORBING DEVICE

[76] Inventor: Robert Oswell, 4729-43rd Street, Lloydminster, Saskatchewan, Canada, S9V 0E6

[21] Appl. No.: 09/138,660

[22] Filed: Aug. 24, 1998

[51] Int. Cl.[7] ..... B63B 21/04

[52] U.S. Cl. ..... 114/253; 114/215

[58] Field of Search ..... 114/242, 250, 114/253, 254, 213, 215; 267/70, 72

[56] References Cited

U.S. PATENT DOCUMENTS

| | | | |
|---|---|---|---|
| 869,130 | 10/1907 | Bierie | 114/215 |
| 3,952,685 | 4/1976 | Hollenbush | 267/72 |
| 5,906,173 | 5/1999 | Day, Jr. et al. | 114/215 |
| 5,934,217 | 8/1999 | Allsop | 114/253 |

*Primary Examiner*—Stephen Avila
*Attorney, Agent, or Firm*—Nixon & Vanderhye, P.C.

[57] ABSTRACT

The invention provides a shock absorbing device for attaching a tow rope to a boat for the purposes of water sports comprising a bias element attached between a boat and the load end of a tow rope such that when a load sufficient to overcome the biassing force of the bias element is placed on the tow rope the separation between the boat and the load end of the tow rope is increased by a limited distance. The bias element can conveniently be located inside a tow rope pylon, with a cable emerging for attachment of the tow rope. In a simple form, the invention can be a spring in line with a tow rope, with a restricted extension. The invention greatly reduces shock to athletes, and is particularly suited to wakeboarding, as the bias element provides a sling-shot effect which allows for higher jumps than would normally be possible.

23 Claims, 5 Drawing Sheets

TOW ROPE SHOCK ABSORBING DEVICE

This invention deals with the field of water sports such as wakeboarding, water skiing and the like, and in particular with a device for towing an athlete engaged in such sports.

BACKGROUND

Boats commonly employ a vertical pylon anchored in the boat for attaching the tow rope necessary for many water sports. Recently, extended pylons which are much higher than formerly known standard pylons, have been developed for use in the emerging sport of wakeboarding. Wakeboarding is a sport similar to water-skiing, wherein an athlete rides a wakeboard which is similar to a snowboard, and uses the boat wake as a ramp to execute jumps, flips, twists and so forth. The extended pylons are necessary to provide some element of vertical pull to the athlete, this vertical pull facilitating jumping higher than would otherwise be possible.

Alternatively, for purely recreational skiing or towing water toys, the tow rope is often simply tied to the boat. This results in an unbalanced pull on the boat however this is not a significant problem for such uses.

In all these water sports there is a problem of shock as the tow rope sometimes goes slack during certain manoeuvres, such as when the boat turns, and then tightens suddenly, with a resulting jerk and shock to the athlete. Tow ropes have a certain element of elasticity, however this must be slight as an elastic rope would reduce the athlete's control of the manoeuvres, leading to wipe-outs and possible injury.

This shock is a particular problem in wakeboarding as the athletes are often air-borne, resulting in a fairly slack rope which tightens and jerks when landing. Water skiers, and people riding tubes and so forth are also subject to such shocks, notably during turns, which can cause loss of control and injury.

A device for absorbing the shock of a tightening rope while allowing the athlete to maintain control would be beneficial in reducing injuries and enhancing the enjoyment of athletes. Such a device that would enhance the jumping abilities of wakeboarders would also be desirable.

SUMMARY OF THE INVENTION

It is an object of the present invention to provide a device for attaching a tow rope to a boat which absorbs shock as the rope is tightened from a slack position.

It is a further object of the present invention to provide such a device which does not interfere with control by the athlete being towed.

It is a further object of the present invention to provide a pylon for mounting in a boat for attaching a tow rope which incorporates such a shock absorbing device inside the pylon.

It is a further object of the present invention to provide an extended pylon for wakeboarding which will allow the athlete to jump higher.

The invention accomplishes these objects providing a shock absorbing device for attaching a tow rope to a boat for the purposes of water sports comprising a bias element attached between a boat and the load end of a tow rope such that when a load sufficient to overcome the biassing force of said bias element is placed on said tow rope the separation between said boat and said load end of the tow rope is increased by a limited distance.

The bias element will be closed until a sufficient load is exerted on the tow rope at which time the bias element will open or extend. This will normally be while "cutting", that is when the athlete is travelling at a large angle to the direction of the boat, as the athlete pulls hardest on the rope when cutting. After the cut the rope often goes relatively slack, with a pronounced droop between the athlete and boat. Initiating another cut snaps the rope tight again, with a resulting shock to the athlete. With the invention installed, the rope gives somewhat as the bias element extends, and this shock is reduced.

The movement of the bias element must be limited to a range of extension such that once the load overcomes the bias force, the element extends a short distance and then stops. At that point the rope is solid again, and the athlete receives normal action from the rope as is required to maintain control. If the extension is too long, the result will be the same as if the rope was elastic, and the athlete would not be able to get a firm pull when needed. It is contemplated that for most purposes this extension should be less than six inches.

The bias element could conveniently be adjustable such that the load necessary to overcome the biassing force may be varied. This would allow for different weights, abilities and preferences of the athletes to be accommodated. Compression or tension springs could be used as bias elements, with the force varied by varying a pre-set force on the springs, or by changing springs.

The bias element could be attached at one end to a pylon mounted in a boat and at the opposite end to a tow rope, thereby providing a biassing force between the boat and the tow rope.

The bias element may "float" during operation somewhere in the middle of its range but it is important that when the athlete pulls hard on the rope, such as when initiating a cut, the rope moves only a short distance before reverting to normal action, thereby providing the firm steady pull required to maintain control. This floating position also reduces shock and improves balance when water-skiing or wakeboarding in rough water.

An embodiment of the invention provides a pylon for a tow rope comprising means to mount the pylon substantially vertically in a boat; a bias element secured in the hollow interior of the pylon; and a cable extending from the interior of the pylon to the exterior thereof through an aperture defined by the top of the pylon, the exterior end of the cable attachable to a tow rope, and the interior end of the cable attached to the bias element; where in operation the exterior end of the cable moves through a range of travel from a minimum distance from the top of the pylon to a maximum distance therefrom when a load sufficient to overcome the biassing force of the bias element is placed on the tow rope.

Another embodiment of the invention provides an extended pylon for attachment of a tow rope to a boat for wakeboarding comprising: means to mount the extended pylon substantially vertically in a boat; a bias element secured in the hollow interior of the pylon; and a cable extending from the interior of the extended pylon to the exterior thereof through an aperture defined by the top of the extended pylon, the exterior end of the cable attachable to a tow rope, and the interior end of the cable attached to the bias element; where in operation the exterior end of the cable moves through a range of travel from a minimum distance from the top of the extended pylon to a maximum distance therefrom when a load sufficient to overcome the biassing force of the bias element is placed on the tow rope.

The extended pylon is much longer than a standard water-ski pylon, and is often secured in a boat by simply placing the hollow extended pylon over top of the existing water-ski pylon and anchoring the top end to the front of the boat.

The extended pylon of the present invention provides, in addition to shock-absorbing benefits, the benefit of a "sling-shot" effect which helps athletes jump higher than is possible with known extended pylons.

Thus the bias element, in either embodiment disclosed above, is conveniently located out of sight, with only a cable attached thereto extending from the pylon. This location also allows for rugged construction of the bias element secured inside the metal pylon.

The bias element could be a compression spring enclosed in a chamber inside the pylon, wherein the means to attach the cable to the spring passes through a hole defined in the upper end of the chamber, then passes through the centre of the compression spring and is fastened to a plate resting under the compression spring on the bottom of the chamber such that when the load placed on the tow rope overcomes the biassing force of the compression spring the plate moves towards the top of the chamber until the compression spring is fully compressed. This gives the limited range of extension of the bias element that is necessary for proper operation.

The length of the chamber, being that distance between the top and the bottom of the chamber, could be adjustable, thereby varying the load required to overcome the biassing force of the bias element, and thereby also varying the range of travel of the exterior end of the cable. As this distance is reduced, the force required to start the extension of the spring is increased, as the spring is pre-loaded. A necessary secondary result is that the range of travel will also be reduced. Appropriate combinations of force and range of travel may be achieved by changing the spring.

In order to ensure that the spring stays in place and to avoid having any position where the cable does not have tension thereon, the spring could be somewhat compressed when the length of the chamber is adjusted to its maximum operational length.

This variable length chamber could be achieved by threading the bottom of the chamber into threads defined in the walls of the chamber, whereby screwing the bottom into or out of the threads on the chamber walls varies the length of the chamber. In this way as well, bottom of the chamber might be removed to give access for changing the spring.

The aperture defined by the top of the pylon, through which the cable extends from the interior to the exterior of the pylon, could be a vertical hole defined by a collar rotatably attached with a vertical axis to the top of the pylon. For example, the collar could comprise the inner race of a bearing, the outer race of the bearing fixedly attached to the pylon. The cable would pass vertically through the collar on top of the pylon and bend into a trailing position. As the tow rope moved from side to side in response to manoeuvres of the towed athlete, the collar would rotate about its vertical axis, reducing friction on the cable.

To reduce friction as the cable moves into and out of the aperture, a pulley could be rotatably attached to the collar such that the axis of rotation of the pulley is substantially horizontal, and wherein the cable is engaged in the exterior groove of the pulley, whereby is the cable passes vertically through the inside of the collar and then makes a bend over the pulley to a trailing position, and whereby as the tow rope moves from side to side in response to manoeuvres of the towed athlete, the collar rotates about its vertical axis and the cable is maintained in engagement with said pulley. As the cable moved in and out of the aperture, the pulley would rotate. The pulley stays in proper alignment with the cable as it moves from side to side since the pulley rotates with the collar.

Alternatively the aperture defined by the top of the pylon, through which said cable extends from the interior to the exterior of said pylon, could be a horizontal slot on the rear side of the top end of said pylon.

To further accommodate wakeboarding preferences, the height of the pylon could be adjustable.

It is clear that other functional alternatives to the embodiments described could be used as well to provide the limited range of movement and the biassing force required by the invention, and such alternatives are therefore considered to fall within the scope of the present invention.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE EMBODIMENT

Figure 1:
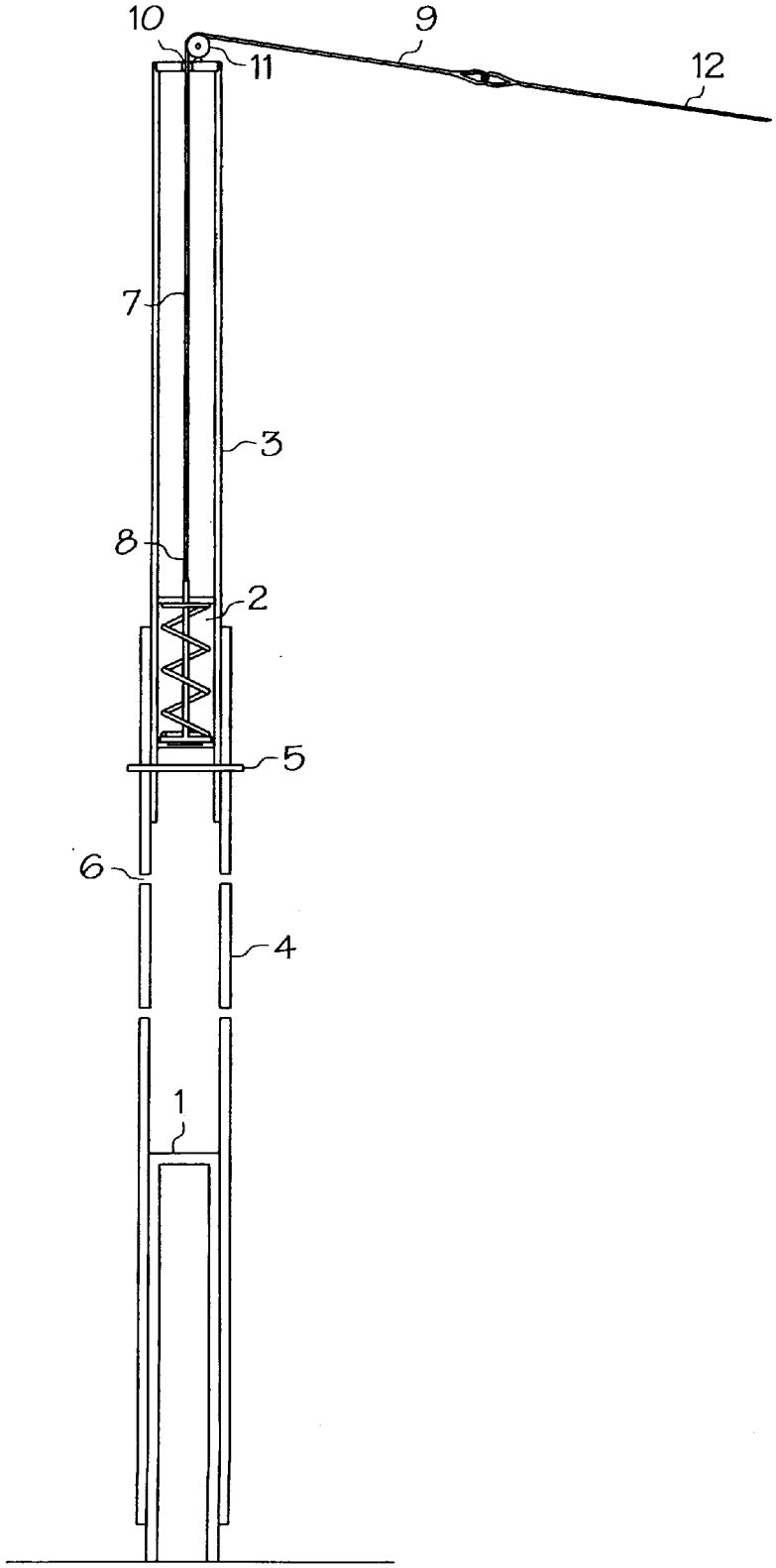
FIG. 1 is a cross-sectional side view of the preferred embodiment, an extended pylon, mounted over an existing standard tow rope pylon.

FIGS. 1 shows one preferred embodiment of the invention, an extended pylon for wakeboarding, as it would be mounted onto a standard pylon 1. The bias element 2 is secured inside the hollow interior of the extended pylon 3. The extended pylon 3 slides into the pylon mounting sleeve 4 and is secured by pin 5. Multiple mounting holes 6 in pylon mounting sleeve 4 allow the extended pylon 3 to be mounted at varying heights to accommodate different preferences. Pylon mounting sleeve 4 slides over top of standard pylon 1 and is further secured by straps to the bow of the boat in the same manner as known extended pylons, and such mounting is not further illustrated.

Cable 7 is attached at its interior end 8 to the bias element 2, and extends up the extended pylon 3, emerging from vertical cable aperture 10 in the top of the extended pylon 3 and over pulley 11 into a trailing position where a tow rope 12 may be attached to the cable exterior end 9.

Figure 2:
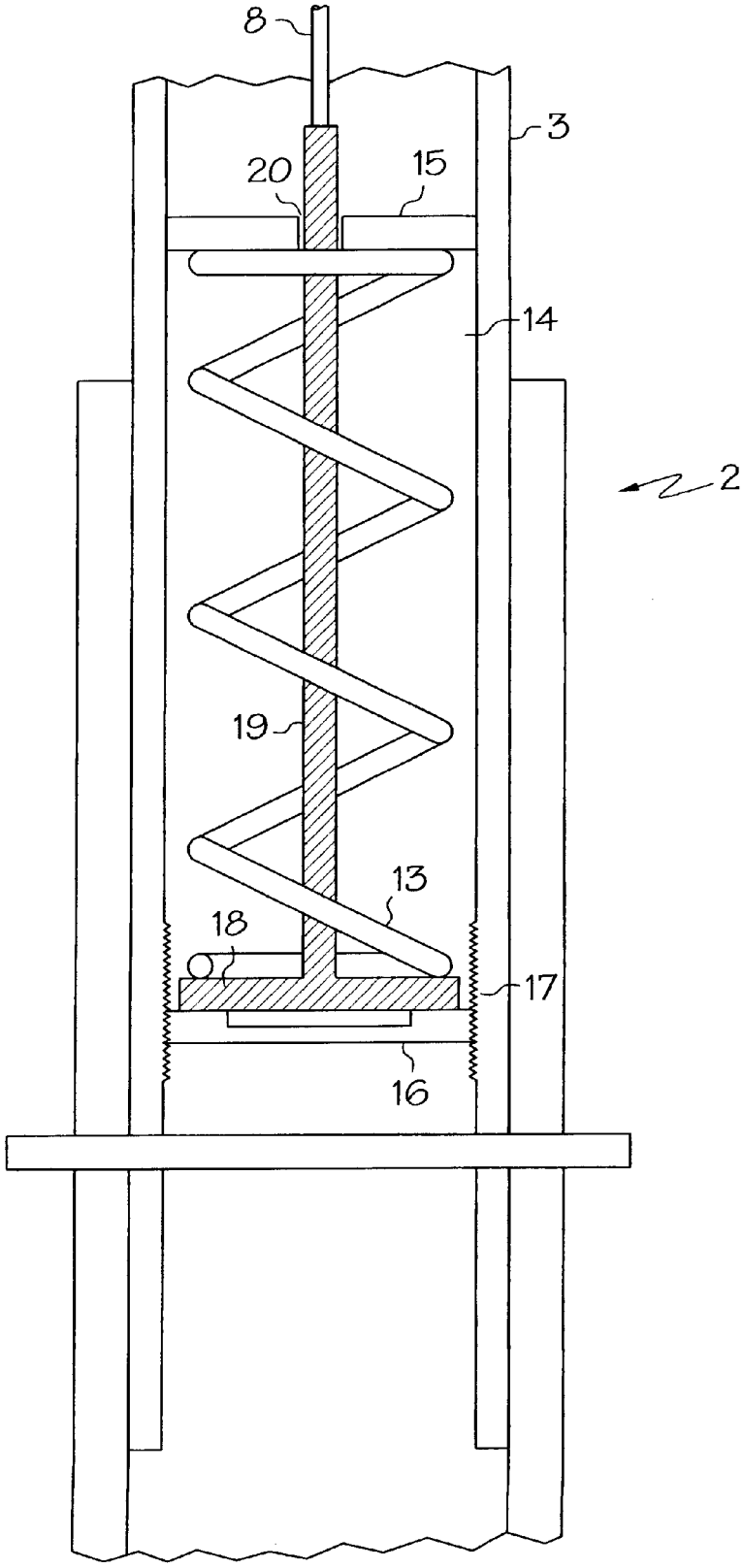
FIG. 2 is an expanded cross-sectional side view of the bias element.

Referring now to FIG. 2, a detailed view of the bias element 2 and its mounting inside the extended pylon 3 is provided. A compression spring 13 is confined in a chamber 14 formed by a chamber top 15, fixed to the interior walls of the extended pylon 3, and a chamber bottom 16 which is engaged in threads 17 in the interior walls of the extended pylon 3. Plate 18 rests on top of the chamber bottom 16, under the spring 13. Cable attachment shaft 19 is secured to plate 18 and extends up through the open centre of spring 13 and through a shaft aperture 20 in the chamber top 15. Cable interior end 8 is fixed to the top end of the shaft 19, thereby attaching the cable 7 to the bias element 2.

The spring 13 must be somewhat compressed when the chamber bottom 16 is initially screwed into the threads 17 in the chamber walls. This ensures that there is always some force on the spring 13, and so the cable 7 is not freely movable at any time.

When a load sufficient to overcome the initial bias force of the spring 13 is placed on the cable 7, via the attached tow rope 12, the plate 18 will start to move towards the top of the chamber 14, against the force of the spring. When this load increases to the point that the spring 13 is fully compressed, the plate 18 stops moving. Thus the limited range of travel required is achieved.

The initial bias force of the spring 13 may be adjusted by screwing the chamber bottom 16 up or down in the chamber 14. This will also change the range of travel of the cable 7. The chamber bottom 16 may be removed to facilitate changing the spring 13, thereby allowing a further wide range of forces and travel ranges to accommodate different weights, abilities and preferences of athletes using the device.

Figure 6:
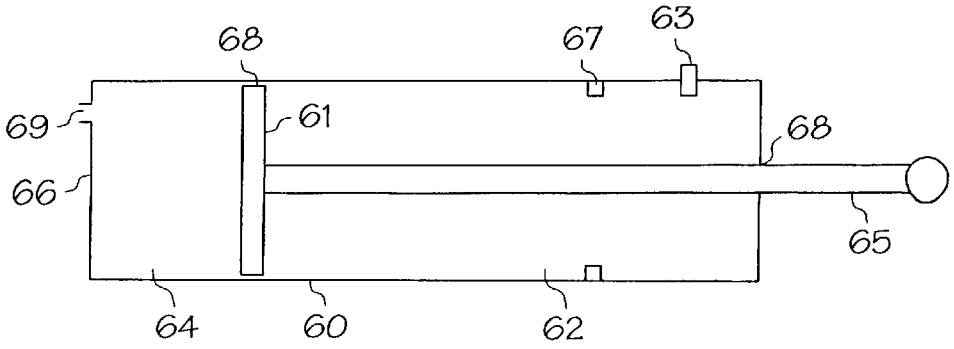
FIG. 6 illustrates the use of a gas hydraulic cylinder as a bias element.

It is contemplated that hydraulic cylinders, tension springs, elastic or other such devices might be used as bias elements and all such variants are intended to fall within the scope of the claimed invention. To illustrate, FIG. 6 shows a diagram of how a gas hydraulic cylinder could be utilized as a bias element. Piston 61 slides inside cylinder 60. The pressure side 62 of the piston 61 is charged with air through valve 63 to provide the desired biassing force. Pressure is maintained therein by conventional seals 68 on the periphery of the piston 61 and between the cylinder 60 and the piston rod 65. This pressure may be adjusted to suit the user. The open side of the piston 64 is vented at vent 69 so that air may move in and out as required by movement of the piston 61.

The piston 61 is illustrated at a mid position in the cylinder 60. Its range of movement is between the open end 66 of the cylinder 60 and the piston stops 67 attached to the inside wall of the cylinder 60. An advantage of this bias element is that the range of movement does not change as the bias force is changed. The bias element of FIG. 6 could be mounted inside the extended pylon 3, or at any other point between the boat and the load end of the tow rope.

Figure 3:
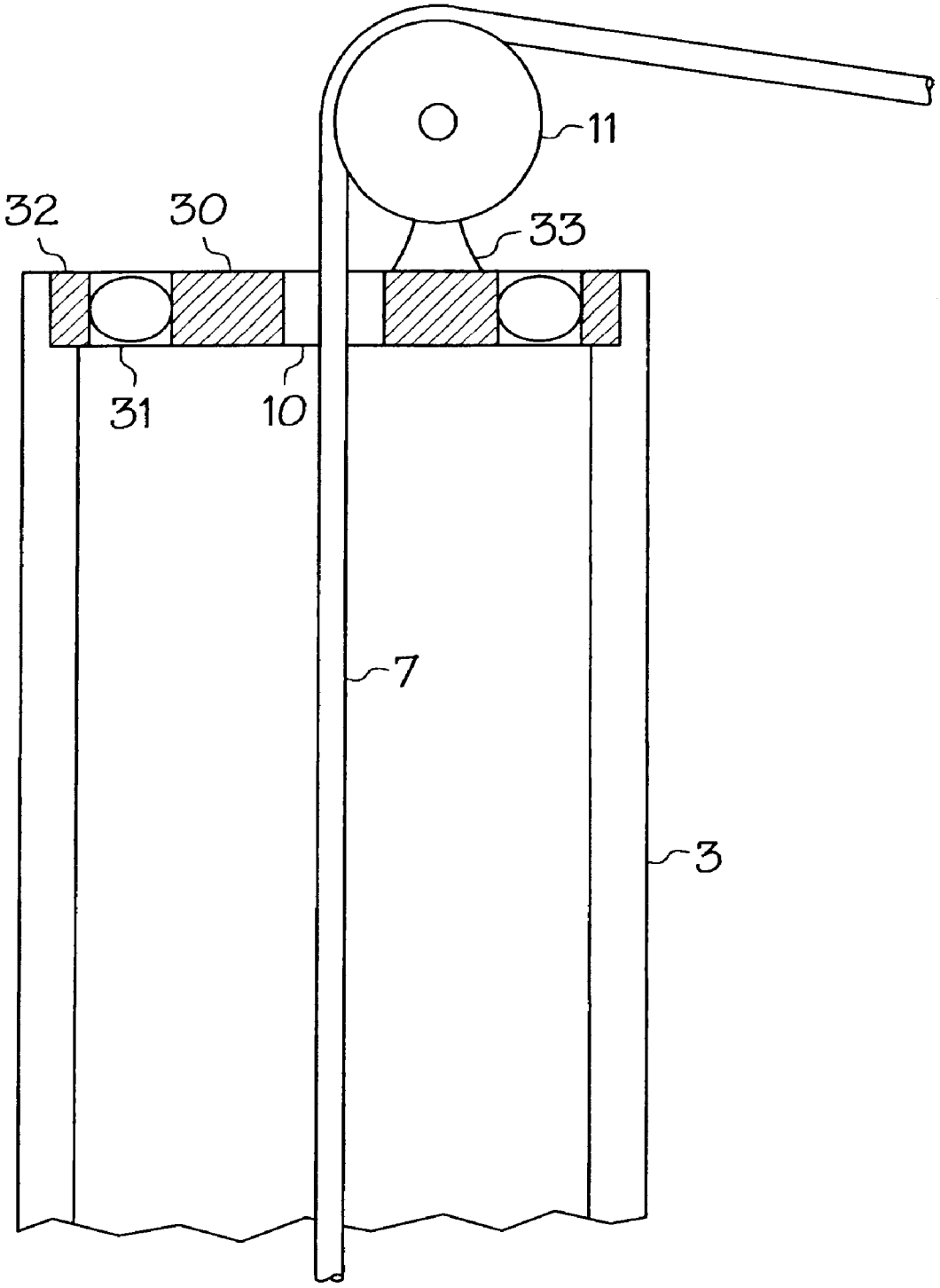
FIG. 3 is a expanded cross-sectional side view of the top of the extended pylon.

FIG. 3 illustrates how the cable 7 emerges from the interior of the extended pylon 3. Vertical cable aperture 10 is defined by the inside opening of a collar 30. Collar 30 in this embodiment is the inner race of a bearing 31, the outer race 32 of which is fixed in the upper end of the extended pylon 3 by conventional means such as set screws or a press fit. Thus collar 30 is free to rotate about a vertical axis. Pulley 11 is mounted via bracket 33 attached to the collar 30, the brackets 33 providing a substantially horizontal axis of rotation for the pulley 11. The cable 7 extends vertically through the cable aperture 10 and engages the groove about the circumference of the pulley 11 as it bends back into a trailing position for attachment of the tow rope 12.

Figure 4A:
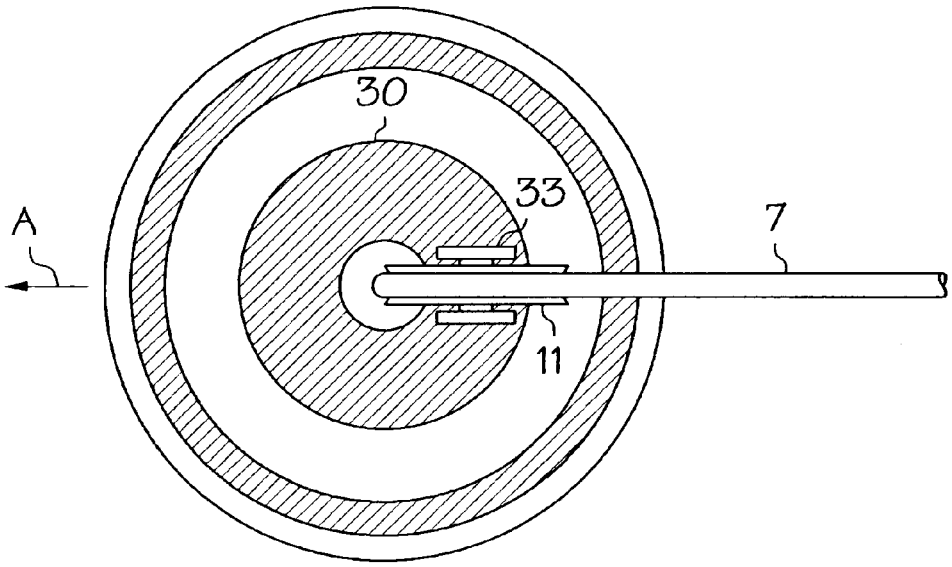
FIG. 4 is a top view of the pylon illustrating the action of the cable and pulley as the tow rope moves from side to side.
Figure 4B:
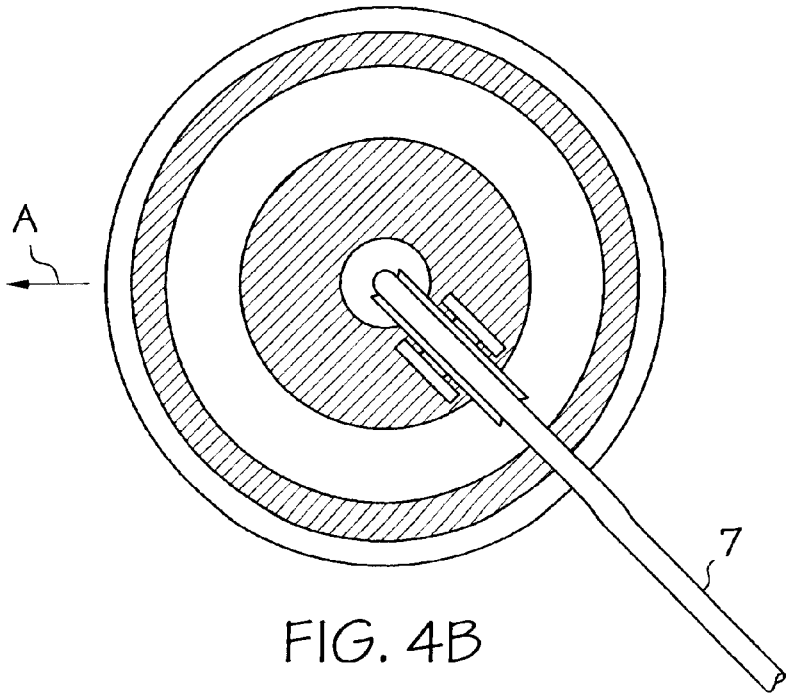

Referring to FIG. 4, where the direction of travel of the boat is indicated by arrow A, it can be seen that as the cable 7 moves to one side, the collar 30 and attached pulley 11 rotate to follow the cable 7, maintaining the cable 7 engaged in the pulley groove. Thus the cable 7 is at no point subjected to rubbing against anything as it emerges from the extended pylon 3. The cable 7 may travel smoothly in and out of the cable aperture 10 in response to changes in the load on the tow rope 12.

The embodiment provides one system wherein the bias element is attached between a boat and the load end of a tow rope such that when a load sufficient to overcome the biassing force of the bias element is placed on the tow rope, the separation between the boat and the load end of the tow rope is increased by a limited distance. Other embodiments are contemplated that would provide the same basic elements. A preferred embodiment for use in a standard water-ski pylon could have an identical bias element and pulley/collar system, simply being located inside a standard height pylon.

Figure 5A:
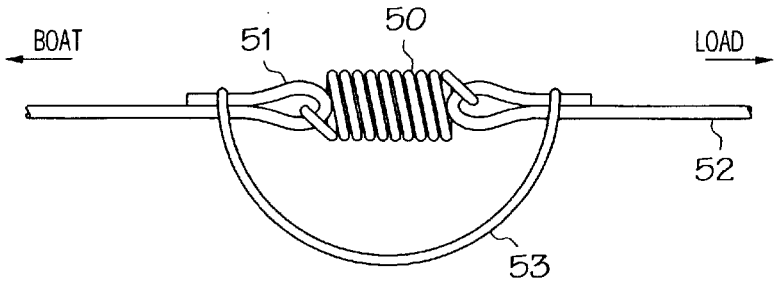
FIG. 5 is a side view of a very simple embodiment for economical use in a tow rope for recreational water sports.
Figure 5B:
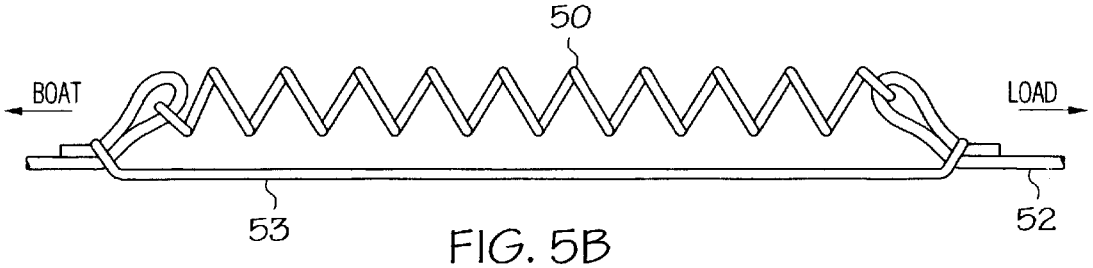

In its simplest form the invention could be a tension spring with its extension limited, as illustrated in FIG. 5. Spring 50 is attached at each end to loops 51 tied off in the tow rope 52. With no load on the spring 50, the rope between the loops 51 is slack. As load sufficient to overcome the biassing force of the spring 50 is exerted on the tow rope 52, the spring 50 begins to extend. When the load is such that the spring 50 is extended to the point where the rope between the loops is tight, the spring stops extending. Thus the separation between the boat and the load end of the tow rope is increased by a limited distance. This simple device would serve to enhance the enjoyment of recreational water sports at a very economical cost.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

I claim:

1. An extended pylon for attachment of a tow rope to a boat for wakeboarding comprising:

a mount for mounting said extended pylon substantially vertically in a boat;

a bias element secured in a hollow interior of said pylon; and a cable extending from the interior of said extended pylon to the exterior thereof through an aperture defined by the top of said extended pylon, an exterior end of said cable attachable to a tow rope, and an interior end of said cable attached to said bias element;

where in operation said exterior end of the cable moves through a range of travel from a minimum distance from the top of said extended pylon to a maximum distance therefrom when a load sufficient to overcome the biasing force of said bias element is placed on said tow rope and wherein said bias element exerts a force towards said extended pylon on the exterior end of said cable when the exterior end of the cable is more than said minimum distance from the top of said extended pylon.

2. The pylon of claim 1 wherein said bias element comprises:

a spring enclosed in a chamber inside said pylon, said chamber having a top end and a bottom end; and wherein said cable is attached to said spring through a hole defined in the top end of said chamber such that said cable exerts a force against the biasing force of the spring; and wherein said range of travel is limited by the length of said chamber, being that distance between said top and bottom ends of said chamber.

3. The pylon of claim 2 wherein said bias element comprises a compression spring enclosed in a chamber inside said pylon, said chamber having a top end and a bottom end, and wherein said cable is attached to an attachment element that passes through a hole defined in the top end of said chamber, then passes through the center of said compression spring and is fastened to a plate resting under said compression spring on the bottom of said chamber such that when the load placed on said tow rope overcomes the biasing force of said compression spring said plate moves towards the top of said chamber until said compression spring is fully compressed.

4. The pylon of claim 3 wherein the length of said chamber is adjustable, thereby varying the load required to overcome the biasing force of said bias element, and thereby also varying said range of travel of the exterior end of the cable.

5. The pylon of claim 4 wherein the bottom of said chamber is threaded into threads defined in the walls of said chamber, whereby said length of the chamber may be adjusted.

6. The pylon of claim 4 wherein said spring is compressed when the length of said chamber is adjusted to its maximum operational length.

7. The pylon of claim 1 wherein said range of travel of the exterior end of the cable is less than six inches.

8. The pylon of claim 1 wherein said bias element comprises a gas hydraulic cylinder.

9. The pylon of claim 1 wherein said aperture defined by the top of the pylon, through which said cable extends from the interior to the exterior of said pylon, is a vertical hole defined by a collar rotatably attached to the top of said pylon.

10. The pylon of claim 9 wherein said collar comprises the inner race of a bearing, the outer race of said bearing fixedly attached to said pylon.

11. The pylon of claim 9 further comprising a pulley rotatably attached to said collar such that the axis of rotation of said pulley is substantially horizontal, and wherein said cable is engaged in an exterior groove of said pulley, whereby said cable passes vertically through the inside of said collar and then makes a bend over said pulley to a trailing position, and whereby as the tow rope moves from side to side in response to manoeuvres of the towed athlete, the collar rotates about its vertical axis and said cable is maintained in engagement with said pulley.

12. The pylon of claim 1 wherein said aperture defined by the top of the pylon, through which said cable extends from the interior to the exterior of said pylon, is a horizontal slot on the rear side of the top end of said pylon.

13. The pylon of claim 1 wherein the height of said extended pylon may be varied.

14. A shock absorbing pylon for a tow rope comprising:

a mount for mounting said pylon substantially vertically in a boat;

a bias element secured in the hollow interior of said pylon; and a cable extending from a hollow interior of said pylon to the exterior thereof through an aperture defined by the top of said pylon, an exterior end of said cable attachable to a tow rope, and an interior end of said cable attached to said bias element;

wherein said aperture defined by the top of the pylon is a vertical hole defined by a collar rotatably attached about a vertical axis to the top of said pylon;

where in operation said exterior end of the cable moves through a range of travel from a minimum distance from the top of said pylon to a maximum distance therefrom when a load sufficient to overcome the biasing force of said bias element is placed on said tow rope.

15. The pylon of claim 14 wherein said collar comprises the inner race of a bearing, the outer race of said bearing fixedly attached to said pylon.

16. The pylon of claim 14 further comprising a pulley rotatably attached to said collar such that the axis of rotation of said pulley is substantially horizontal, and wherein said cable is engaged in an exterior groove of said pulley, whereby said cable passes vertically through the inside of said collar and then makes a bend over said pulley to a trailing position, and whereby as the tow rope moves from side to side in response to manoeuvres of the towed athlete, the collar rotates about its vertical axis and said cable is maintained in engagement with said pulley.

17. The pylon of claim 14 wherein said aperture defined by the top of the pylon, through which said cable extends from the interior to the exterior of said pylon, is a horizontal slot on a rear side of the top end of said pylon.

18. A shock absorbing pylon for a tow rope comprising:

a mount for mounting said pylon substantially vertically in a boat;

a cable extending from a hollow interior of said pylon to the exterior thereof through an aperture defined by the top of said pylon, an exterior end of said cable attachable to a tow rope, and an interior end of said cable attached to a compression spring located inside the hollow interior of said pylon;

said compression spring enclosed in a chamber inside said pylon, and wherein said cable is attached to an attachment element that passes through a hole defined in an upper end of said chamber, then passes through the centre of said compression spring and is fastened to a plate resting under said compression spring on a bottom end of said chamber such that when the load placed on said tow rope overcomes the biasing force of said compression spring said plate moves towards the top of said chamber until said compression spring is fully compressed; and where in operation said exterior end of the cable moves through a range of travel from a minimum distance from the top of said pylon to a maximum distance therefrom when a load sufficient to overcome the biasing force of said bias element is placed on said tow rope.

19. The pylon of claim 18 wherein the length of said chamber, being that distance between said top and said bottom of the chamber, is adjustable, thereby varying the load required to overcome the biasing force of said bias element, and thereby also varying said range of travel of the exterior end of the cable.

20. The pylon of claim 19 wherein said spring is compressed when the length of said chamber is adjusted to its maximum operational length.

21. The pylon of claim 18 wherein said range of travel of the exterior end of the cable is less than six inches.

22. The pylon of claim 19 wherein the bottom of said chamber is threaded into threads defined in the walls of said chamber, whereby said length of the chamber may be adjusted.

23. The pylon of claim 18 wherein said bias element comprises a gas hydraulic cylinder.

* * * * *